US006557621B1

(12) United States Patent
Dierksmeier et al.

(10) Patent No.: US 6,557,621 B1
(45) Date of Patent: May 6, 2003

(54) CASTING CORE AND METHOD OF CASTING A GAS TURBINE ENGINE COMPONENT

(75) Inventors: Douglas D. Dierksmeier, Franklin, IN (US); Jeffrey A. Ruppel, Indianapolis, IN (US)

(73) Assignees: Allison Advanced Development Comapny, Indianapolis, IN (US); Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 09/480,331

(22) Filed: Jan. 10, 2000

(51) Int. Cl.[7] ..... B22C 9/10
(52) U.S. Cl. ..... 164/369; 164/368
(58) Field of Search ..... 164/365, 368, 164/369, 370, 122.1, 122.2

(56) References Cited

U.S. PATENT DOCUMENTS 3,773,506 A 11/1973 Larker et al.
4,042,162 A 8/1977 Meginnis et al.
4,361,181 A 11/1982 Wischnack et al.
4,421,153 A 12/1983 Wilkinson et al.
4,532,974 A 8/1985 Mills et al.
4,569,384 A 2/1986 Mills
4,637,449 A 1/1987 Mills et al.
4,989,664 A 2/1991 Roth
5,243,759 A 9/1993 Brown et al.
5,250,136 A 10/1993 O'Connor
5,291,654 A * 3/1994 Judd et al. ..... 29/889.721
5,641,014 A * 6/1997 O'Connor et al. ..... 164/516

* cited by examiner

*Primary Examiner*—M. Alexandra Elve
*Assistant Examiner*—Len Tran
(74) *Attorney, Agent, or Firm*—Woodard, Emhardt, Naughton, Moriarty & McNett

(57) ABSTRACT

An integral ceramic casting core includes a base portion with a plurality of rods extending therefrom and a plurality of apertures formed therein. The base portion defines a passageway for the passage of a cooling media within a cast component. The plurality of rods forming cooling media inlet passages to the passageway and the plurality of apertures are adapted to receive molten metal therein and form heat transfer pedestals within the passageway.

10 Claims, 4 Drawing Sheets

CASTING CORE AND METHOD OF CASTING A GAS TURBINE ENGINE COMPONENT

This invention was made with U.S. Government support under contract N00019-96-C-0176 awarded by the U.S. Navy, and the U.S. Government may have rights in the invention.

BACKGROUND OF THE INVENTION

The present invention relates generally to ceramic casting cores used in the production of cast components. More particularly, in one embodiment of the present invention an integral ceramic casting core having a flat plate portion with apertures formed therein, and a plurality of rod members extending therefrom is utilized in an investment casting process to define the cooling passages and heat transfer pedestals in a cast gas turbine engine airfoil. Although the present invention was developed for use in the production of gas turbine engine components certain applications may be outside of this field.

Investment casting is a well-known technique for the production of superalloy blades and vanes for gas turbine engines, particularly those requiring an internal cooling scheme. In investment casting, a ceramic shell mold is formed around a wax pattern with one or more ceramic cores precisely positioned within the wax pattern, occupying the position of required holes and passages in the casting to be produced. The wax pattern is subsequently removed during a firing operation, while the mold and cores remain in place, thus providing a mold cavity. Molten metal is poured into and solidified in the cavity and the ceramic cores are chemically removed.

In many prior art investment casting systems, the ceramic cores are individually positioned and aligned in a predetermined manner by a skilled technician. The complexity of the cooling scheme geometry and the requirement for the precision location of the ceramic cores in order to reproduce the cooling scheme design in the cast component can be a very time consuming and expensive process.

Although investment casting techniques utilizing individual ceramic cores are suitable for producing many types of cast gas turbine engine components, the need remains for an improved ceramic casting core and method of use. The present invention satisfies this need in a novel and unobvious way.

SUMMARY OF THE INVENTION

One form of the present invention contemplates an integral ceramic casting core having a plurality of pin members extending therefrom and a plurality of holes formed therein for receiving a molten metal.

Another form of the present invention contemplates a casting core comprising: a substantially planar ceramic main body member having a first surface and a second surface and a thickness less than about 0.020 inches, the member having a plurality of spaced holes formed therein having a size of about 0.030 inches and adapted for receiving a molten metal therein; and a plurality of ceramic members having a nominal width of about 0.020 inches that are connected with the first surface, each of the ceramic members are disposed normal to the first surface.

One object of the present invention is to provide a unique ceramic casting core.

Related objects and advantages of the present invention will be apparent from the following description.

DESCRIPTION OF THE PREFERRED EMBODIMENT

Figure 1:
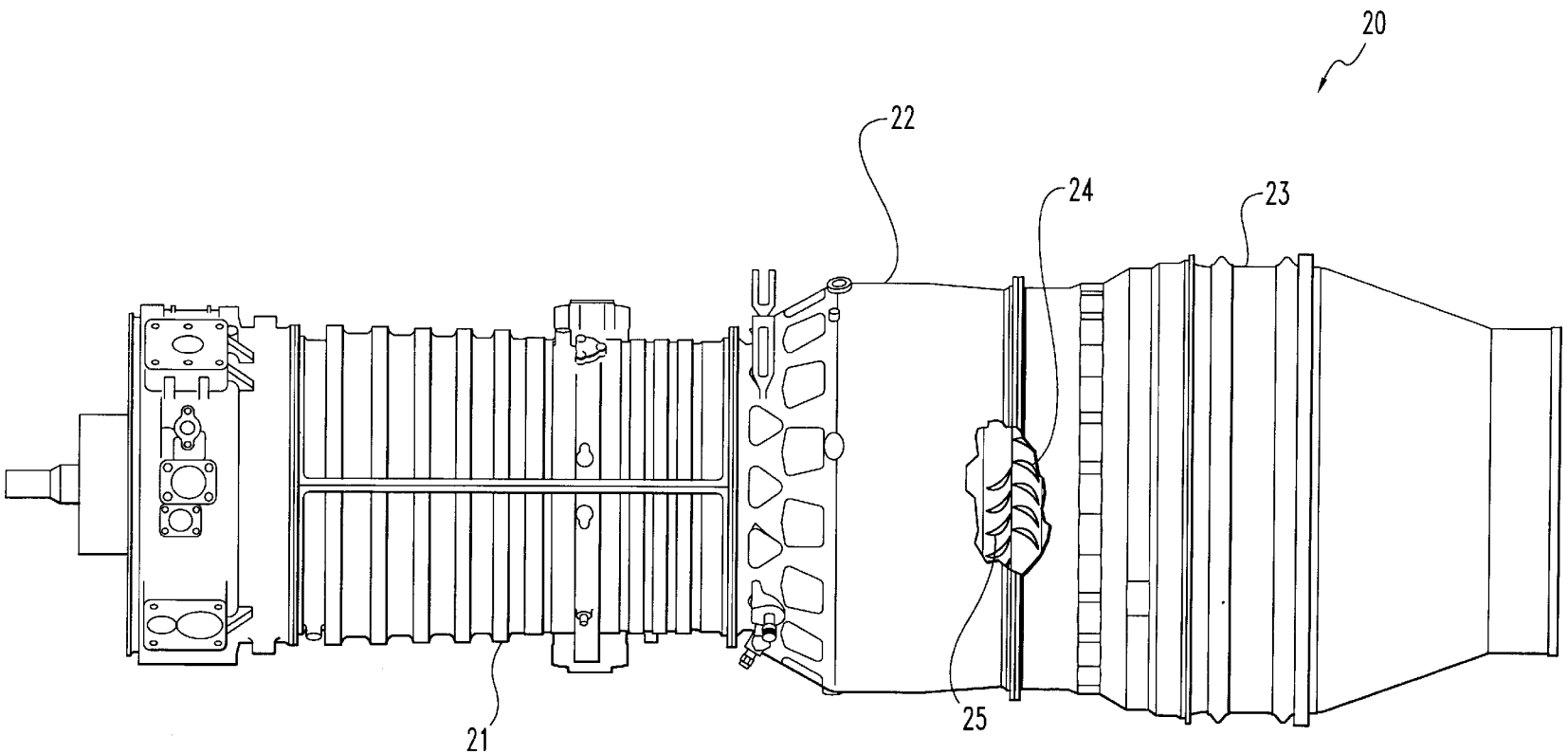
FIG. 1 is an illustrative view of a typical gas turbine engine, partially cut away to show the gas turbine engine vanes and blades.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a gas turbine engine 20 that includes a compressor 21, a combustor 22, and a turbine 23. The gas turbine engine 20 has been partially cut away to reveal a plurality of blades 24 coupled to a rotor assembly and a plurality of vanes. While the turbine 23 has been shown cut away to expose the blades 24 and vanes 25, it is known to one of ordinary skill in the art that the compressor 21 also includes a plurality of blades and vanes. Unless specified to the contrary, the term airfoil will be used herein to refer to blades and vanes.

Figure 2:
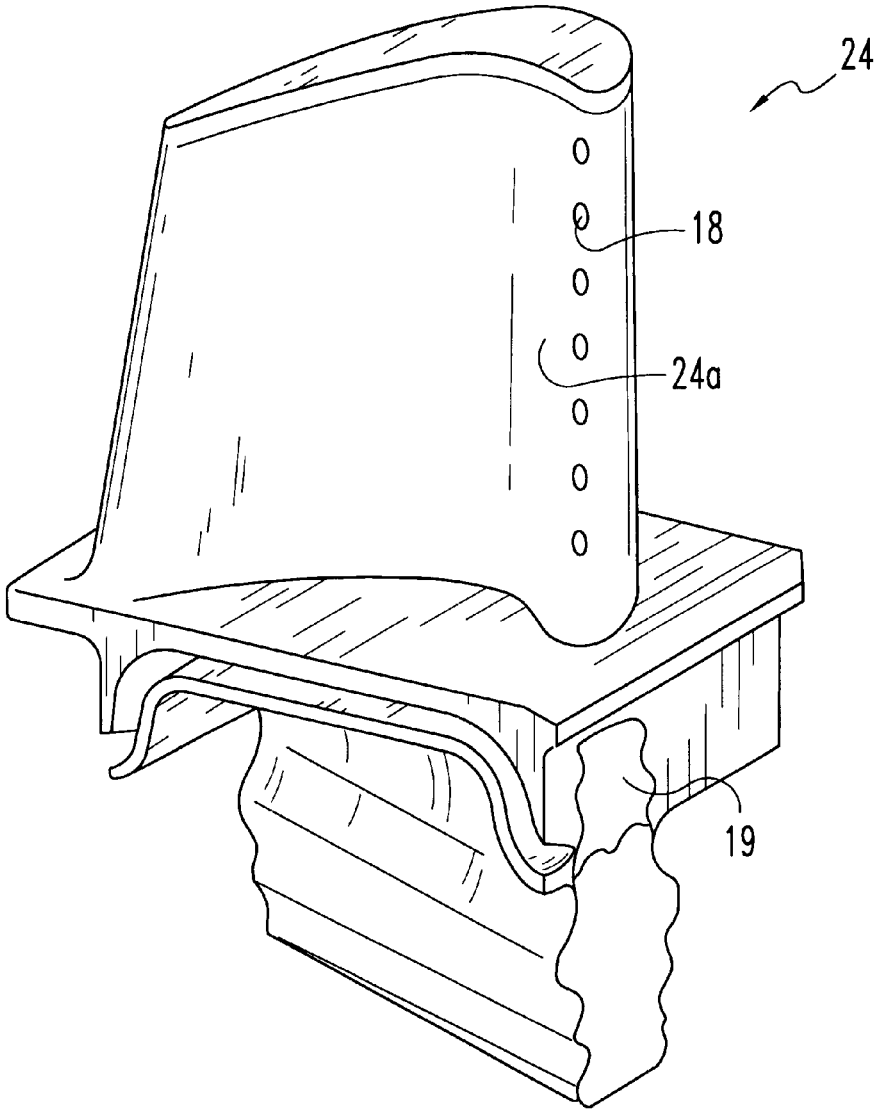
FIG. 2 is an illustrative view of a gas turbine engine blade that may be manufactured using one embodiment of the present invention.
Figure 3:
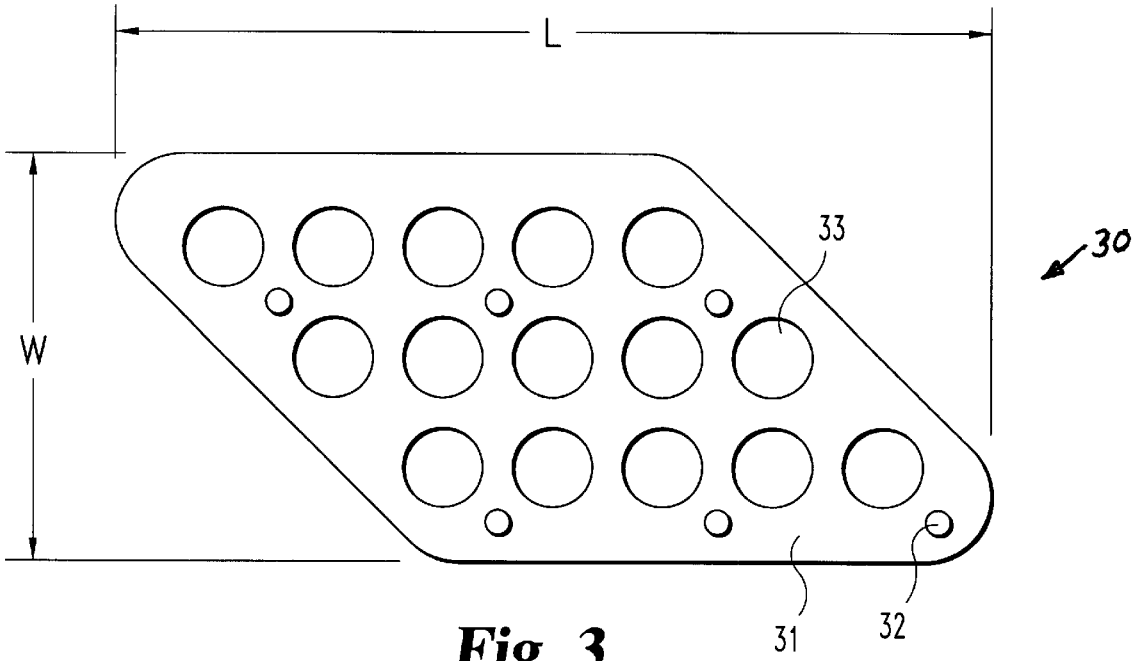
FIG. 3 is a plan view of one embodiment of a casting core of the present invention.
Figure 4:
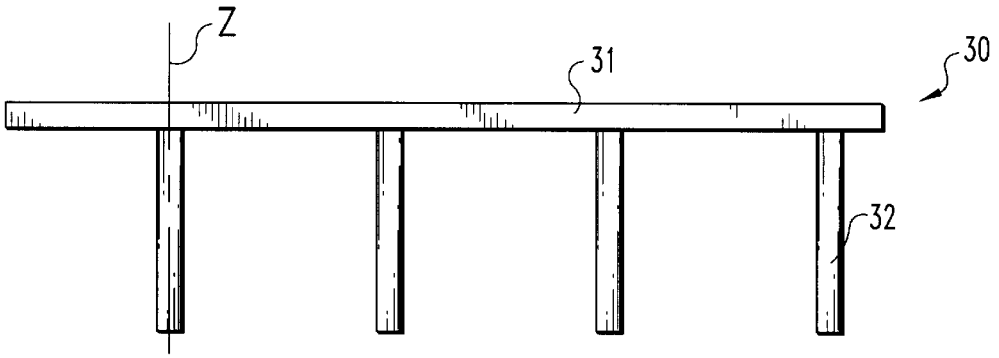
FIG. 4 is a side view of the casting core of FIG. 3.

With reference to FIG. 2, there is illustrated a blade 24 representative of the type used in a gas turbine engine 20. Airfoils in gas turbine engines are typically designed and constructed with internal cooling passages adapted to receive a cooling medium therein. Typically, the cooling medium flows through a central cavity 19 within the airflow 24 and is discharged into a plurality of cooling cavities located within the airfoil 24. In many airfoil designs contemplated herein, the cooling medium is discharged from the plurality of cooling cavities through a series of apertures 18 onto the surface of the airfoil. The present invention is not limited to the formation of cooling passages within a gas turbine engine blade, and is applicable to the formation of cavities within cast components, including but not limited to vanes, bladetracks, platforms and endwalls Referring to FIG. 3, there is illustrated a plan view of one embodiment of a ceramic core 30 of the present invention. The ceramic core 30 includes a base portion 31 having a plurality of holes 33 formed therethrough for the receipt of molten metal, and a plurality of upstanding members 32 coupled thereto. In one embodiment a substantially planar plate member defines the base portion 31, and preferably the base portion 31 has a thickness of about 0.02 inches. Further, in a preferred embodiment, the base portion 31 has an approximate width indicated by 'W' of about 0.25 inches, and an approximate length indicated by 'L' of about 0.50 inches. However, other geometric shapes and sizes are contemplated herein. The thickness of the base portion 31 being about 0.020 inches has been found to be small enough to minimize thermally induced stress in the cast component during the solidification of the molten metal. Further, the number of holes 33 formed through the base portion 31 is preferably within the range of about 10–40, and more preferably is about 20. In one embodiment, the holes have a diameter of about 0.030 inches. However, other hole diameters and sizes are contemplated herein.

In one embodiment a centerline 'Z' of the plurality of upstanding members 32 is oriented perpendicular to the base portion 31. In one embodiment the upstanding member is an elongated cylindrical member with a constant nominal diameter of about 0.020 inches. However, the selection of the diameter of the upstanding members 32 is a function of the desired fluid flow rate into the cooling cavity, and the diameter may be varied do to concerns associated with clogging of the fluid flow inlet apertures. In one embodiment the plurality of upstanding members are about 0.10 inches long. However, in alternate embodiments the upstanding members 32: have alternative diameters, which may vary over the length of the member; lengths, which can vary between different members on the same casting core; cross sectional shapes, which can be round, oval, eliptical, and, are oriented at different angles with respect to the base portion. However, other geometric cross-sections and angles are contemplated herein.

In one embodiment the plurality of upstanding members 32 are mechanically connected to the base portion 31 by a fusion process, such as but not limited to a laser processing operation or a torch melting operation. In another embodiment the casting core is formed by a gel casting process in which the core is subsequently sintered. Further, in another embodiment, the core is an injection molded fused silica core. The number of upstanding members 32 is preferably within a range of about 7–8, and more preferably is about 6.

In one embodiment, the ceramic casting core 30 is preferably formed of a fused silica material, having a density of about $36.2\times10^3$ lbs/cm$^3$. Alternate ceramic materials having different densities are contemplated herein. The material of the ceramic casting core is capable of being removed by leaching after the component has been is cast.

Figure 5:
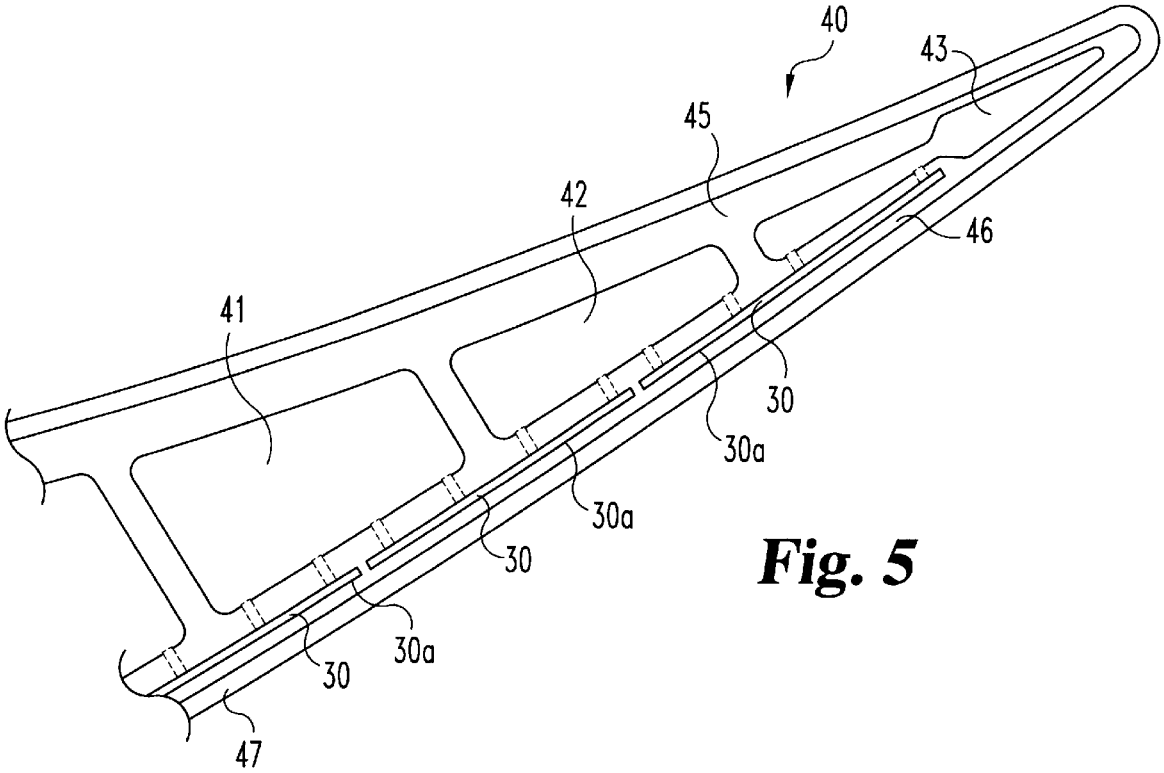
FIG. 5 is a cross section view of an investment casting mold comprising a plurality of casting cores of the present invention.

With reference to FIG. 5, there is illustrated a plurality of casting cores 30 positioned within an investment casting mold assembly 40. The plurality of casting cores 30 are coupled to a series of inner casting cores 41, 42 and 43. The inner casting cores 41, 42 and 43 in one embodiment are formed of silica. It is understood herein that the number and shape of the inner casting cores will be tailored to fit the design of the particular cast component, and the representative inner cores are not meant to limit the type, number and shape of the inner cores. Surrounding the inner casting cores 41, 42 and 43 is a wax layer 45. Wax layer 45 is preferably formed around the inner casting cores by injection. The plurality of casting cores 30 are positioned on the wax layer 45 and the plurality of upstanding members 32 pass through the wax layer 45 and contact the inner cores. A wax layer 46 is positioned on the outer surface 30*a* of the casting core 30. The assembly is then shelled with a ceramic system to form the outer ceramic casting mold shell 47. The ceramic shell consists of primary layers for pattern detail, and backup layers for mechanical reinforcement. The layers comprise a slurry portion and a stucco portion. In one embodiment, the slurry portion is formed from a ceramic flour, water and a binder; and the stucco portion includes a coarse ceramic sand which provides support to the slurry coat. The flour is preferably zircon, and the binder is preferably collidal silica. Preferably the ceramic sand is an alumina material having varying particle sizes.

Figure 6:
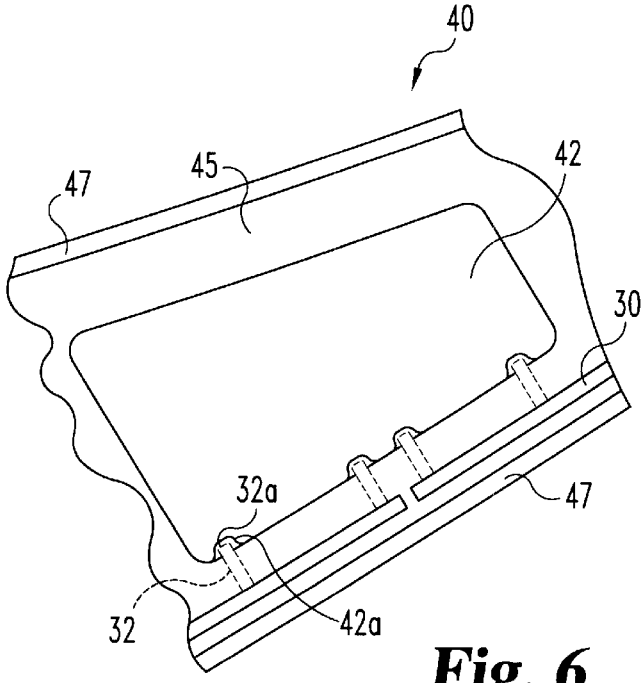
FIG. 6 is an enlarged partial view of the casting mold of FIG. 5.

With reference to FIG. 6, there is illustrated an enlarged portion of the investment casting mold 40. The upstanding members 32 are connected to the inner casting core 42. In one embodiment an end 32*a* of the upstanding member 32 is received within a pocket 42*a* formed in the inner casting core 42. In one form the end 32*a* is held in place during the casting process by a frictional engagement between the outer surface of the upstanding member 32 and the wall of the pocket 42*a*. In one embodiment, the size of the opening to the pocket is about twice the diameter of the end 32*a*. In an alternate embodiment the end 32*a* is held in place by a high temperature ceramic adhesive. The adhesive is preferably a ceramic adhesive that is removeable by leaching. One example of a ceramic adhesive is cermabond, sold by AREMCO of Valley Cottage, N.Y.

The number and shape of the casting cores 30 is configured to replicate the cooling scheme design within the cast component. The process of casting a component includes the acts of positioning the inner casting cores 41, 42 and 43 in a predetermined relationship. Surrounding the inner casting cores 41, 42 and 43 with a wax layer 45. Orienting the individual casting cores 30 and passing the ends 32*a* of the upstanding member 32 through the wax layer and into the pockets 42*a*. In one form the adhesive is delivered by a syringe into the pockets 42*a*. Placing an additional layer of wax 47 over the outer surface 30*a* of the ceramic casting cores. The subassembly is then shelled by a ceramic casting mold shelling system. The ceramic casting mold is now heated to remove the wax and molten metal is introduce into the cavity within the casting mold. As a person of ordinary skill in the art will readily appreciate the wax regions are now metal and the regions where the inner casting cores and ceramic cores were will be voids after the cores are removed. In a subsequent machining operation a series of discharge apertures are formed through the outer surface of the component. The discharge apertures, see FIG. 2 for an example, connect with the inner-cooling cavity formed by the casting core 30. One method of forming the discharge apertures is with an EDM process.

While the invention has been illustrated and described in detail in the drawings and foregoing description, the same is to be considered as illustrative and not restrictive in character, it being understood that the preferred embodiment has been shown and described and that all changes and modifications that come within the spirit of the invention are desired to be protective.

What is claimed is:

1. An apparatus, comprising:

at least one primary body core having a plurality of pockets formed therein;

a plurality of secondary ceramic cores, each of said secondary cores including a substantially planar main body member having a first surface and a second surface and a thickness less than about 0.020 inches, said member having a plurality of spaced holes formed therein adapted for receiving a molten metal therein, and wherein said spaced holes have a size of about 0.030 inches, and each of said secondary cores includes a plurality of members having a nominal width of about 0.020 inches that are integrally connected at a first end with said first surface and a second end, each of said ceramic members are disposed normal to said first surface;

each of said second ends of said plurality of members of the secondary cores is disposed within a corresponding one of said plurality of pockets.

2. The apparatus of claim 1, wherein said main body member and said plurality of members are formed of a fused silica material

3. The apparatus of claim 2, wherein said plurality of members are fused to said main body member.

4. The apparatus of claim 2, wherein said main body member and said plurality of members define a unitary casting core.

5. The apparatus of claim 1, wherein each of said second ends of said plurality of members of the secondary cores is held within a corresponding one of said plurality of pockets by an adhesive.

6. The apparatus of claim 5:

wherein said main body member and said plurality of members are formed of a fused silica material.

7. An apparatus, comprising:

at least one primary body core having a plurality of pockets formed therein;

a plurality of secondary ceramic cores, each of said secondary cores including a substantially planar main body member formed of a fused silica material and having a first surface and a second surface and a thickness less than about 0.020 inches, said member having a plurality of spaced holes having a size of about 0.030 inches formed therein adapted for receiving a molten metal therein, and each of said secondary cores includes a plurality of members formed of a fused silica material and having a nominal width of about 0.020 inches that are connected at a first end with said first surface and a second end, each of said ceramic members are disposed normal to said first surface;

each of said second ends of said plurality of members of the secondary cores is disposed within a corresponding one of said plurality of pockets.

8. The apparatus of claim 7, wherein said main body member and said plurality of members define a unitary casting core.

9. The apparatus of claim 8, wherein each of said second ends of said plurality of members of the secondary cores is held within a corresponding one of said plurality of pockets by an adhesive.

10. The apparatus of claim 9:

wherein each of said second ends of said plurality of members of the secondary cores is held within a corresponding one of said plurality of pockets by an adhesive; and wherein said main body member and said plurality of members are formed of a fused silica material.

* * * * *